United States Patent [19]

Falberg

[11] Patent Number: 4,939,972

[45] Date of Patent: Jul. 10, 1990

[54] ADJUSTABLE DRUM CLAMP

[76] Inventor: William H. Falberg, P.O. Box 1183, Carbondale, Colo. 81623

[21] Appl. No.: 269,624

[22] Filed: Nov. 9, 1988

[51] Int. Cl.[5] ..... G10D 13/02

[52] U.S. Cl. ..... 84/422.4; 84/329; 84/411 R; 84/453; 24/514

[58] Field of Search ..... 84/329, 421, 422.2, 84/422.3, 422.4, 411 R, 453

[56] References Cited

U.S. PATENT DOCUMENTS

| | | | |
|---|---|---|---|
| 1,431,836 | 10/1922 | Nelson | 84/415 |
| 1,914,652 | 6/1933 | Stoer | 84/420 |
| 2,417,972 | 3/1947 | D'Arcy | 84/422.3 |
| 2,524,518 | 10/1950 | D'Arcy | 84/411 R |
| 2,844,064 | 7/1958 | Bendett | 84/421 |
| 4,671,158 | 6/1987 | Saputo | 84/411 M |
| 4,691,612 | 9/1987 | Smith | 84/422 R |

FOREIGN PATENT DOCUMENTS

| | | | |
|---|---|---|---|
| 282421 | 8/1952 | Switzerland | 84/420 |

*Primary Examiner*—Lawrence R. Franklin
*Attorney, Agent, or Firm*—Donald W. Erickson

[57] ABSTRACT

An adjustable drum clamp which is particularly useful for assisting the drummer in executing the difficult rim shot. The clamp is useful also for holding drum accessories such as a microphone or cymbal to the drum and for joining together two drums. The clamp comprises a generally rectangular block member having attachment means on its inner end surface for securing the block to the side of the drum. The block member is provided with two or more generally vertically aligned bores in which there is positioned adjustable holding members for holding a drum stick or the like.

10 Claims, 4 Drawing Sheets

ADJUSTABLE DRUM CLAMP

BACKGROUND OF THE INVENTION

This invention is directed at an adjustable drum clamp which is versatile and easily operated. For example, the clamp is very useful for executing the difficult rim shot.

A rim shot is a percussion note commonly used when sharp accents are required. It combines the resonance of the drum head with that of the drum's shell and produces a loud, cracking sound. A rim shot is made by either (A) striking the drum head and rim simultaneously with the hand outside of the rim or (B) holding one end of the stick to the drum head with the tips of thumb and forefinger and slamming the free end of the stick into the rim with the hand inside the rim's diameter.

Method A has the advantage of being louder and sharper in that it allows a longer backswing, thereby being more dynamic. The disadvantage of this method is that it is difficult to execute because the alignment has to be perfect. That is, if the stick doesn't hit the rim at exactly the same moment as the head, you get either a soft click or a loud sound—not a rim shot. It is this difficulty of execution that makes method A undependable.

Method B has the advantage of being consistent in tone. Also, it has the advantage of ease of execution because the three-part alignment of band, rim and head is reduced to merely pushing down on or striking the center of the stick. A disadvantage of this method is that the grip required does not permit the fingers to fit between the drum head and stick. In other words, it is an awkward grip and the grip change takes time. Furthermore, by keeping one end of the stick pinned to the drum head, you lose the speed and power of an unrestricted backstroke.

SUMMARY OF THE INVENTION

The adjustable drum clamp of the present invention overcomes the foregoing disadvantages. It overcomes the foregoing disadvantages by providing adjustable means for clamping a drum stick across the drum head and the rim simultaneously. To execute a rim shot, all the drummer needs to do is hit the stick; anywhere and at any angle in accordance with the resonance or pitch desired. The clamp of the present invention allows the drum stick to contact the drum head at any position on the head and the stick can be extended or retracted easily.

DETAILED DESCRIPTION OF THE INVENTION

Figure 1:
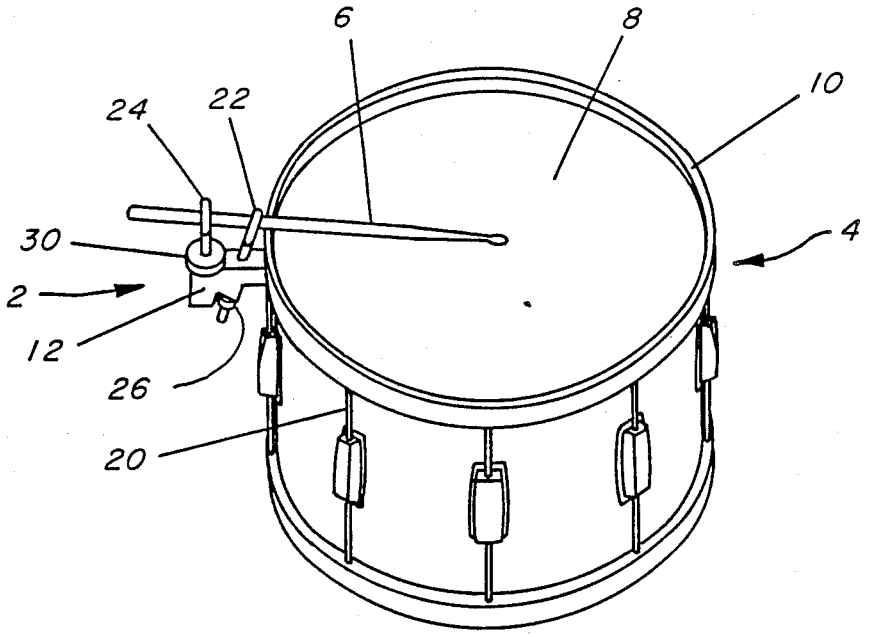
FIG. 1 is a perspective view of my adjustable drum clamp attached to a drum.
Figure 3:
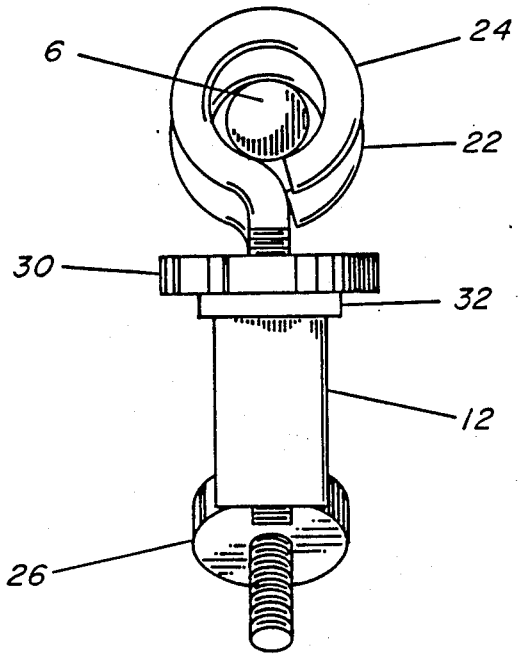
FIG. 3 is an end view of the clamp of FIG. 1, without showing the drum.
Figure 4:
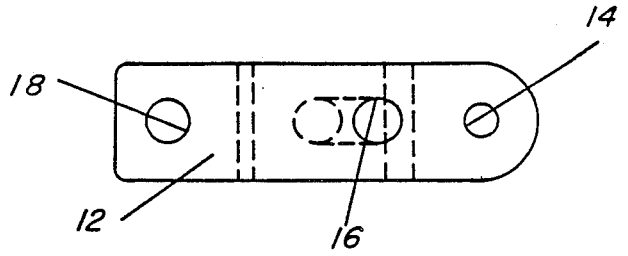
FIG. 4 is a top plan view (enlarged), of the block member of the clamp.
Figure 2:
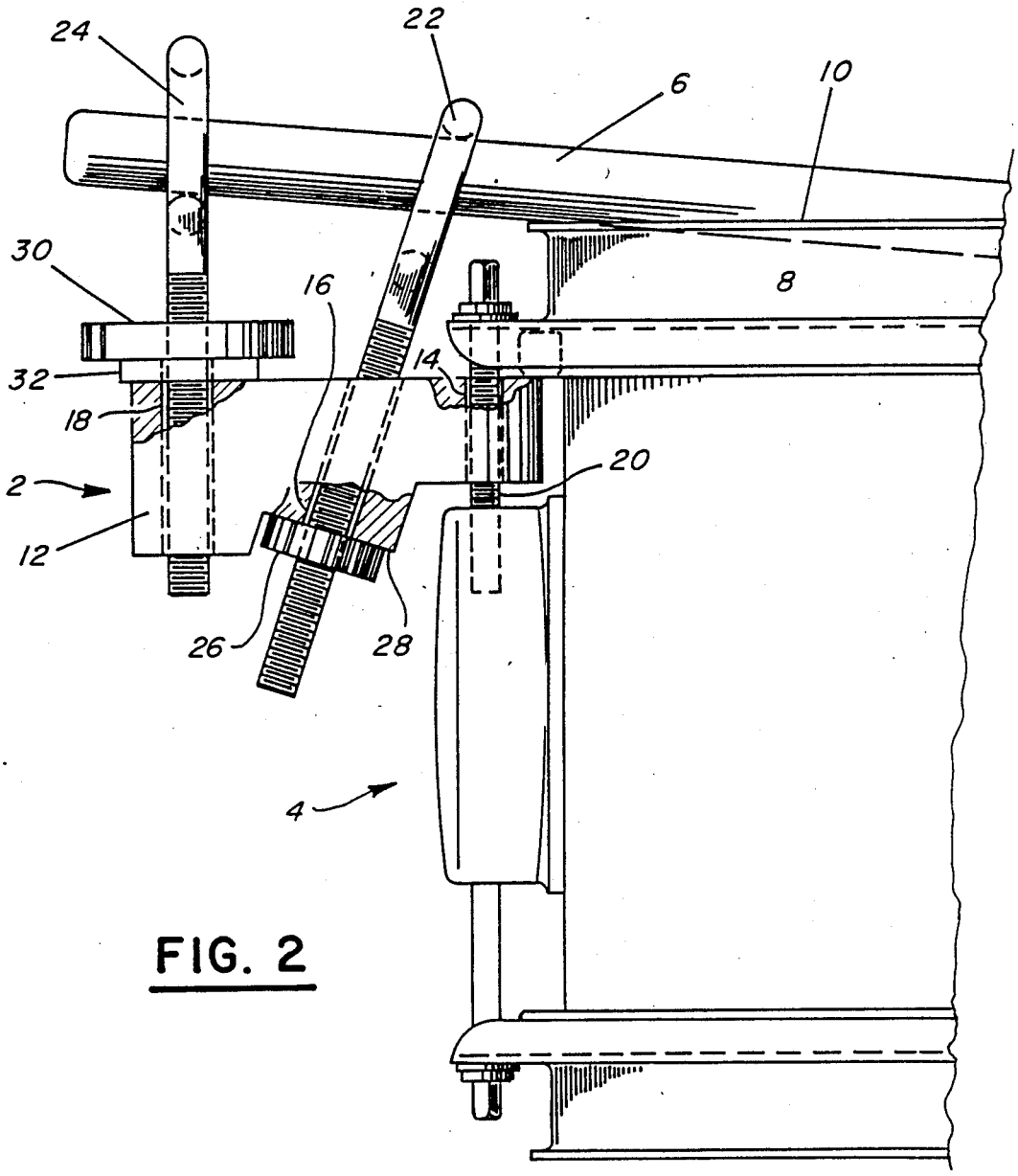
FIG. 2 is an enlarged, side view, in partial cross section, of the clamp of FIG. 1.
Figure 9:
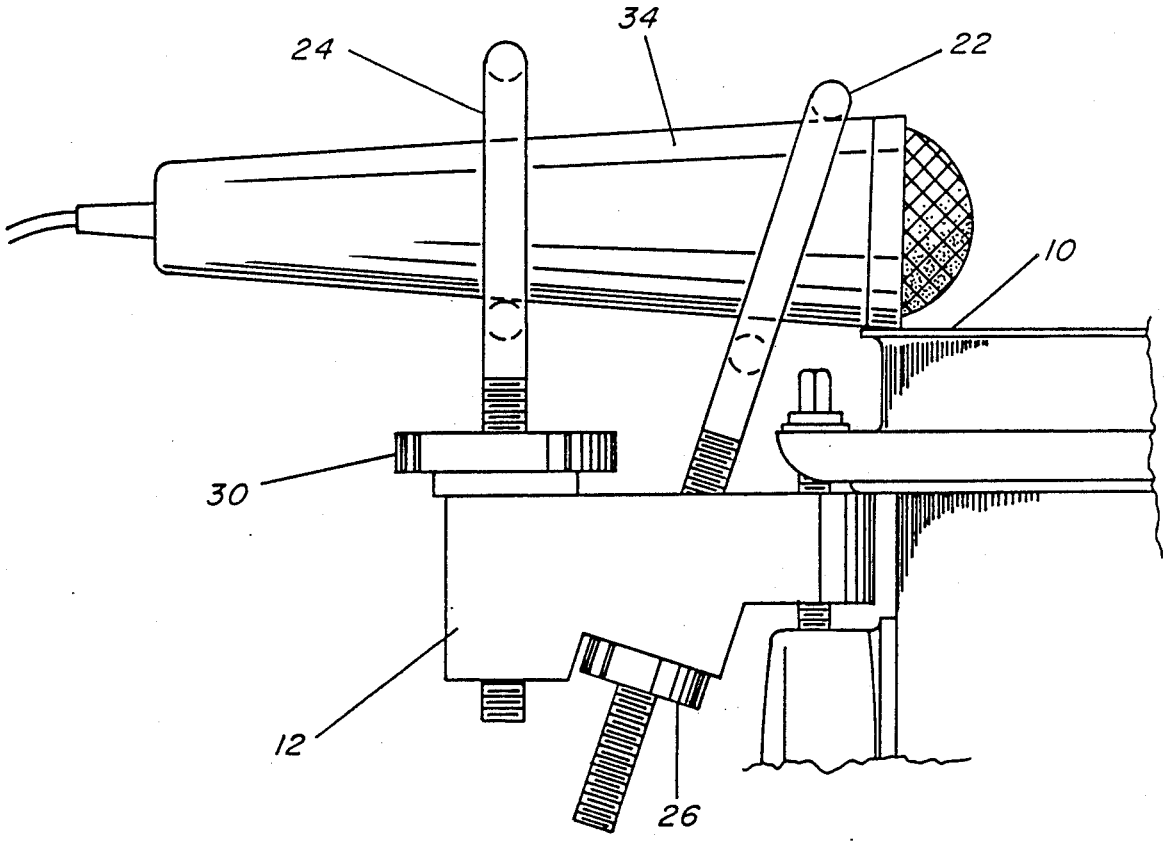
FIG. 9 is a side view, partial section, of the clamp of FIG. 1, holding a microphone to the drum head.

Referring to FIG. 1, there is shown an adjustable drum clamp 2 of the present invention mounted on drum 4. The clamp is holding drum stick 6 in contact with the drum head 8 and rim 10 simultaneously in a position ready for executing a rim shot by simply striking the stick with the hand or a stick. In the preferred embodiment, best seen in FIGS. 1–4, the adjustable clamp of the present invention comprises a generally rectangular block member 12 provided with three vertically aligned bores 14, 16 and 18. The first bore 14 is provided to attach the block member 12 to the drum. A bore having a diameter of about 7/32 inch is suitable to receive drum tuning screw 20 along the drum shell. In this way, the clamp is securely and easily attached to the drum and yet can be rotated for 180° or slightly more. The pivotal attachment of the clamp is advantageous to the drummer because it enables the drummer to easily and readily change the point of impact of the drum stick on the drum head. As best seen in FIGS. 1 and 2, the middle or second bore 16 is positioned at an acute angle relative to the vertical axis and slanted toward bore 14. By slanting bore 16, the point of intersection of stick 6 with rim 10 does not interfere with the top head of the tuning screw 20 nor the bottom of the eye of eye bolt 24. Positioned within bore 16 is an adjustment member such as eye bolt 22 for holding the drum stick. The eye bolt 22, when tightened, exerts downward pressure on stick 6. Bolt 22 is raised or lowered by adjusting means such as round nut 26 threaded on the lower end of the bolt. The bottom face of block member 12 is stepped or inclined as at 28 at the bottom opening of bore 16 so that nut 26 is in smooth, positive engagement with the bottom of the block member. The third bore 18 is vertically aligned and receives adjusting member eye bolt 24 and adjusting means such as round nut 30 which, when tightened, exerts upward pressure at the heel of stick 6. A washer 32, such as a soft rubber washer, is positioned under nut 30 to aid in turning the nut and preventing the nut from working loose. Similarly, but not shown, a washer can be positioned between nut 26 and the bottom face of the block member. With bolt 24 putting upward pressure on, and bolt 22 putting downward pressure on stick 6, the stick is firmly held in place and correct alignment with rim 10 and drum 8 maintained. To execute a rim shot, all the drummer needs to do is to strike stick 6. In the foregoing described embodiment of FIGS. 1–4, the block member measures about 2½ inches in length, ¾ inch in width and 1 inch in height. The threaded eye bolt adjusting means 22 and 24 are 5/16 inch with a length of 4 inches and 3¼ inches, respectively, and eye of ¾ inch. The bores 16 and 18 measure ⅜ inch so as to permit upward and downward movement of the bolts 22 and 24. The foregoing dimensions or measurements are presented as a guide only. Obviously, in the practice of the present invention, the dimensions or measurements can be varied considerably without departing from the scope or spirit of the invention. For example, in the use of the invention to hold a microphone 34, as shown in FIG. 9, the eye of bolts 22 and 24 may need to be larger than the size given above in order to accommodate the barrel of the microphone.

Figure 5:
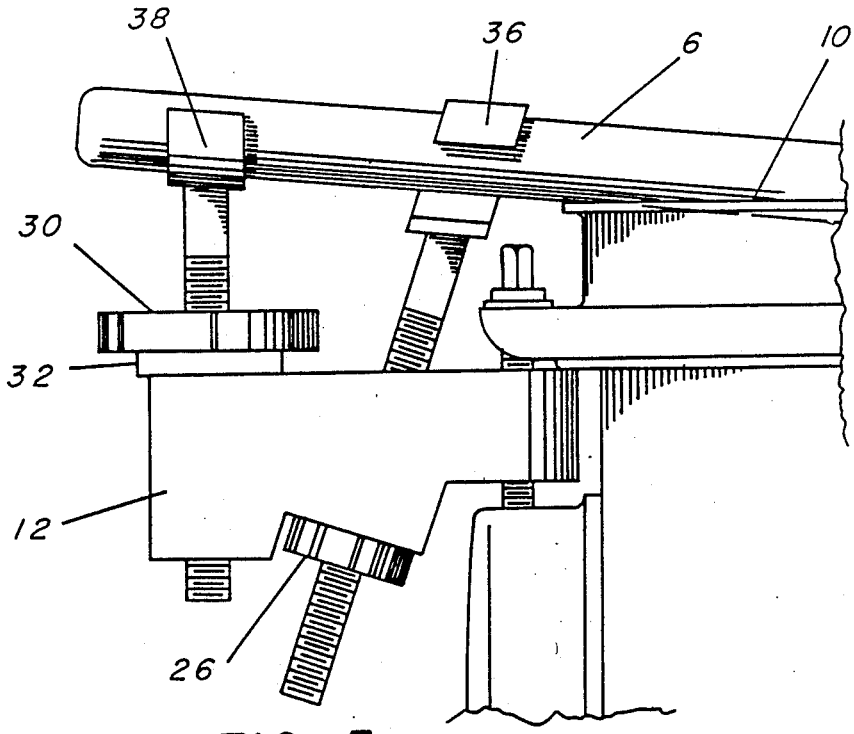
FIG. 5 is a perspective view showing another embodiment of my adjustable drum clamp.
Figure 6:
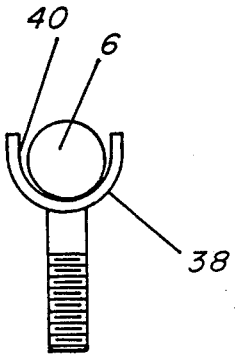
FIG. 6 is an end view of the outer adjustment member of FIG. 5.
Figure 7:
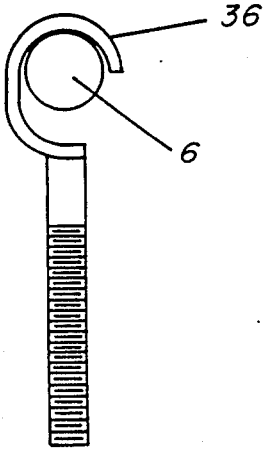
FIG. 7 is an end view of the inner adjustment member of FIG. 5.

Referring to FIGS. 5–7, another embodiment of my invention is shown holding a drum stick, dowel, or other item. In this embodiment, the head of outer adjustment member 38, which exerts upward pressure on the stick 6 by turning round nut 30 clockwise, is bowel-shaped or U-shaped providing a trough 40 for holding the stick. Alternatively to the bowel-shaped trough, the trough can be V-shaped or rectangular. The outer adjustment members 24 and 38 serve to exert upward pressure on the stick and the head thereof can take many forms so long as the head is of adequate surface area to support the stick and a sufficient depression or trough is provided to inhibit accidental slippage of the stick off of the head. The head of the inner adjustment member 36 in this embodiment is in the general shape of a hook as best seen in FIG. 7. The inner adjustment member 36, like adjustment member 22, puts downward pressure on stick 6, when round nut 26 is turned counter-clockwise. The head of the inner adjustment member can take many forms as long as the head has a top portion in contact with the top surface of the stick capable of pulling down on the stick when nut 26 is turned. For example, the head of inner member 36 can be an inverted V-, U- or L- shape or a circle as shown in FIG. 2. Briefly stated, the head of adjustable holding members 22, 24, 36 and 38 is not limited to the forms shown in the drawings.

Figure 8:
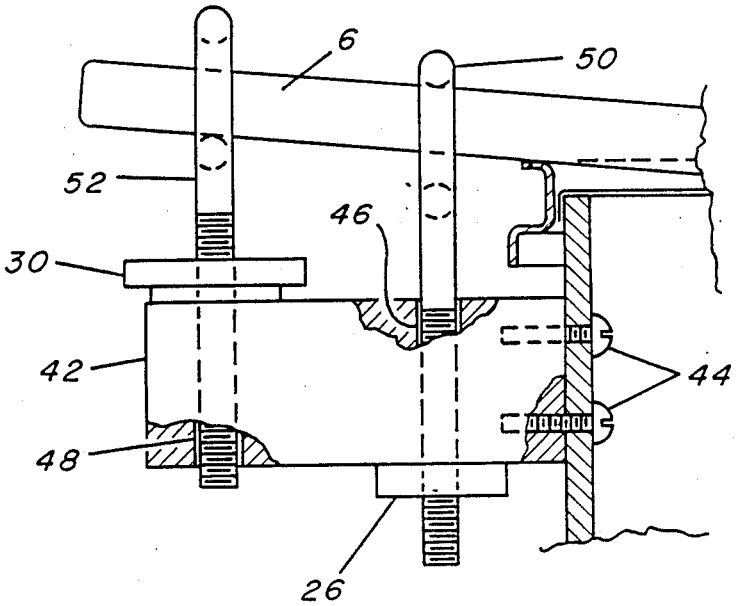
FIG. 8 is a side view, partial cross section, of another embodiment of the adjustable clamp of the present invention.

In another embodiment of the present invention, see FIG. 8, the block member 12 is rectangularly shaped and secured to the drum shell by screws or bolts 44. Preferably, the inner end surface is slightly curved to conform to the curvature of the drum shell. In this embodiment, the inner bore 46 and the outer bore 48 are vertically aligned. Like the embodiment of FIG. 2, the bores extend through the bottom and top surface of block member 12. Adjustable holding members 50 and 52, which are shown as threaded eye bolts as in FIGS. 1–4, are adjusted using round nuts 26 and 30. Member 50 puts downward pressure on the stick and member 52 puts upward pressure on the stick.

Figure 10:
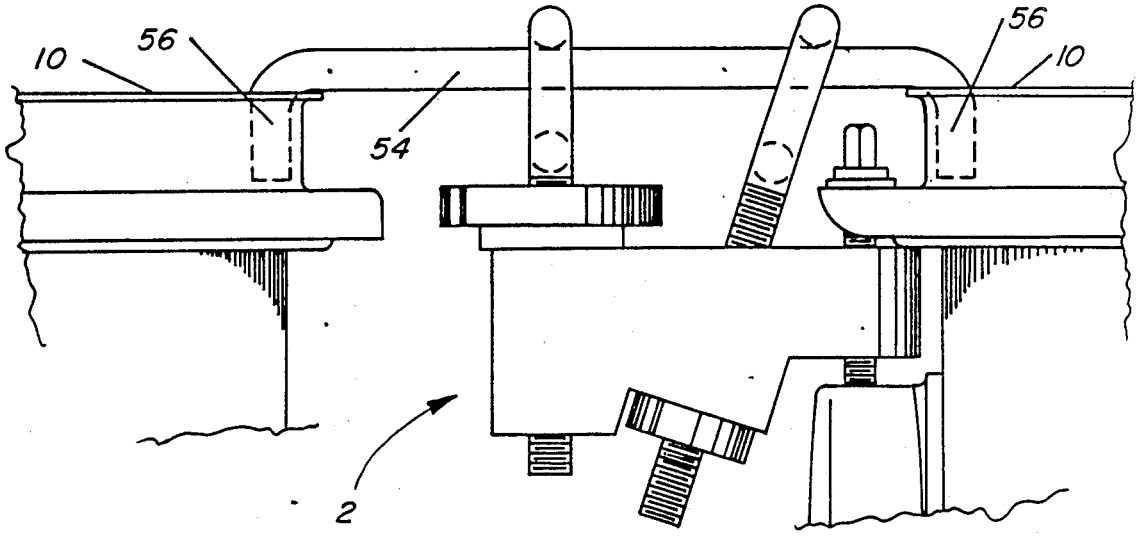
FIG. 10 is a side view, partial section, showing the use of the clamp of FIG. 1 to join together two drums.

As shown in FIG. 10, my clamp can be used to join together two drums. The clamp 2 firmly and securely holds bar member 54 which has lugs 56 engaging the drum rim 10 and thereby preventing the drums from moving apart. The under surface of bar member 54 can be provided with additional lugs or grooves to permit adjustment of the distance between the drums and to prevent movement of the drums inwardly.

The clamp of the present invention can be made of metal or plastic or a combination thereof. Suitable metals include aluminum, steel and alloys such as brass. Suitable plastics include nylon, ABS, polycarbonates, phenol-formaldehyde polymer, and the like.

Although the invention has been described in detail relative to various embodiments thereof, it is to be understood that such was for illustration and explanatory purposes and various modifications in design can be made by those of ordinary skill in the art without departing from the spirit and scope of the invention.

What is claimed is:

1. An aid for effecting a rim shot on a drum, comprising:

a drum having a rim and a drum head;

a drumstick; and clamping means connected to said drum for rigidly holding said drumstick against said rim and said drumhead simultaneously such that one end of said drumstick rests on said drumhead and an intermediate portion of said drumstick rests on said rim, whereby striking said drumstick with another drumstick will effect said rim shot.

2. An aid as in claim 1 wherein said clamping means comprises:

a generally rectangular block member having a first end connected to said drum;

a supporting member mounted on a second end of said block for supporting a second end of said drumstick; and a pinching member mounted intermediate said first and second ends for clamping said drumstick adjacent said intermediate portion of said drumstick.

3. An aid as in claim 2 wherein said block member is pivotally connected to said drum.

4. An aid as in claim 3 wherein said drum has a tuning screw for tuning said drumhead, said block member has a first bore near said first end, and said block member is pivotally connected to said drum by means of said tuning screw extending through said first bore.

5. An aid as in claim 2 wherein said drum has a body and said block is fixed to said drum body by means of screws extending through said body into said block.

6. An aid as in claim 2 wherein said supporting member and said pinching member are vertically adjustable.

7. An aid as in claim 6 wherein said supporting member consists of an adjustable bolt having a concave, upwardly directed surface for receiving said one end of said drumstick and said pinching member consists of an adjustable bolt having a concave, downwardly directed surface for pulling on said drumstick adjacent said intermediate portion.

8. An aid as in claim 7 wherein said supporting member and said pinching member are eye bolts.

9. An aid as in claim 8 wherein said supporting member and said pinching member extend through second and third bores, respectively, in said block member and adjusting nuts for fixing said supporting and pinching members in selected positions.

10. An aid as in claim 9 wherein said first and second bores extend through said block substantially parallel to the side of said drum body and said third bore for receiving said pinching member is slanted relative to said first and second bores.

* * * * *